US005218722A

United States Patent [19]

Vandenberg

[11] Patent Number: 5,218,722

[45] Date of Patent: Jun. 15, 1993

[54] TIE FASTENER

[76] Inventor: Mark L. Vandenberg, 3595 52nd St., SE., Kentwood, Mich. 49512

[21] Appl. No.: 879,973

[22] Filed: May 6, 1992

[51] Int. Cl.[5] ..... A41D 25/02

[52] U.S. Cl. ..... 2/145; 2/152 R; 24/49 R

[58] Field of Search ..... 2/1, 2, 141 A, 144, 2/141 R, 145, 148, 149, 150, 152 R, 152 A, 153; 24/49 R, 198, 200, 49 CF, 49 KC, 49 K, 49 M, 49 CC, 49 CP, 49 S, 49 A, 49 P, 49 M; 229/120, 120.07, 120.12, 120.35, 914

[56] References Cited

U.S. PATENT DOCUMENTS

| | | | |
|---|---|---|---|
| 1,672,196 | 6/1928 | Blackwell | 229/120.35 X |
| 2,008,949 | 7/1935 | Ellsworth | 229/120.12 X |
| 2,530,975 | 11/1950 | Lewis | 2/150 |
| 2,611,529 | 9/1952 | Currivan | 229/120.12 X |
| 2,614,259 | 10/1952 | Sorenson | 2/153 |
| 2,617,108 | 11/1952 | Anzel | 2/153 |
| 2,714,719 | 8/1955 | Peak | 2/152 |
| 2,749,014 | 6/1956 | Russell et al. | 229/120 X |
| 2,774,971 | 12/1956 | Schrade | 2/152 |
| 2,804,252 | 8/1957 | Nate | 229/120 |
| 2,920,808 | 1/1960 | McWhorter | 229/120.35 X |
| 2,939,624 | 6/1960 | Wilson | 229/120 X |
| 2,950,850 | 8/1960 | Corcoran | 229/120 |
| 2,990,995 | 7/1961 | Wessell | 229/120 X |
| 3,077,294 | 2/1963 | Barrez | 229/162 X |
| 3,191,769 | 6/1965 | Schroeder | 229/162 X |
| 3,364,500 | 1/1968 | Fox | 2/150 |
| 3,745,614 | 7/1973 | Tsang | 24/152 |
| 3,899,121 | 8/1975 | Herbetko | 229/120 X |
| 4,105,152 | 8/1978 | Elward | 229/120 X |
| 4,142,665 | 3/1979 | Jewell et al. | 229/120 X |
| 4,173,792 | 11/1979 | Intengan | 2/148 X |
| 4,206,513 | 6/1980 | Collins | 2/152 |
| 4,573,219 | 4/1986 | Hooten | 2/152 R |
| 4,875,239 | 10/1989 | Patterson | 2/145 X |
| 5,088,120 | 2/1992 | Yen | 2/150 X |

FOREIGN PATENT DOCUMENTS

| | | | |
|---|---|---|---|
| 0381251 | 8/1990 | European Pat. Off. | 2/148 |
| 2627355 | 8/1989 | France | 2/145 |
| 0000894 | 11/1979 | World Int. Prop. O. | 2/148 |

*Primary Examiner*—Clifford D. Crowder
*Assistant Examiner*—Jeanette E. Chapman
*Attorney, Agent, or Firm*—Price, Heneveld, Cooper, DeWitt & Litton

[57] ABSTRACT

A tie fastener and related method of use is disclosed. The tie fastener generally includes a front wall having upper, lower and side walls adjoined to one another, thereby forming a hollow interior, accessible via an open rear and a plurality of passages for accommodating a necktie. The fastener provides a retainer bar and alternative guide wall within its interior to engage a necktie and thus secure the necktie when worn by the user.

16 Claims, 3 Drawing Sheets

TIE FASTENER

BACKGROUND OF THE INVENTION

The present invention relates to a device and related method for tying a necktie. Tying a necktie might well be considered an art in view of the level of skill required to tie the various knots that are known, the frequently occurring disparities between appearances of the same knots tied on different occasions, and variations in styles of neckties which are available. Various approaches have been attempted to provide a simplified, consistent means of forming an attractive necktie knot or resemblance of one. The prior art has attempted to provide such a means by clip-on knot covers, hinged knot covers, tie slides... etc. but has failed to provide a device which participates in forming the necktie knot, while providing a decorative appearance, and permitting easy adjustment of the necktie.

SUMMARY OF THE INVENTION

The tie fastener of the present invention includes a plurality of sides and walls adjoined to one another about a front wall, thereby generally enclosing the interior of the fastener. The interior of the fastener is accessible from the rear and through a plurality of passages formed in the sides and walls. A method of knot formation is disclosed wherein a necktie is passed through the passages and about a wearer's neck in such a way that it is secured within the interior of the tie fastener.

The tie fastener of the present invention participates and aids in forming the necktie knot. The tie fastener minimizes wrinkling and wear of the necktie material otherwise resulting without the use of the present invention. Moreover, the present invention provides a decorative means to fasten a necktie about the wearer's neck. In addition, the present invention enables easy adjustment of the necktie about the wearer's neck in contrast to neckties worn without the present invention.

DETAILED DESCRIPTION OF THE DRAWINGS

DESCRIPTION OF THE PREFERRED EMBODIMENTS

The present invention is embodied in a tie fastener, a preferred form of which is shown in FIGS. 1–8 and referenced by numeral 1. In preferred form tie fastener 1 includes four apertures or passages 20, 30, 40 and 50 through which a necktie 70 (FIGS. 10–14) is passed in sequence. With necktie 70 fitted through tie fastener 1, the assembled necktie 70 can be slipped over the head of the wearer. Once necktie 70 is in place about the neck of the wearer, tie fastener 1 is slid upwardly to tighten necktie 70 and produce a neat, aesthetically pleasing appearance.

Figure 1:
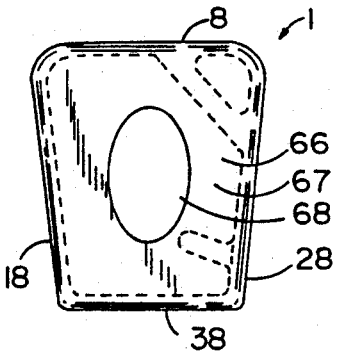
FIG. 1 is a front elevational view of the tie fastener embodying the present invention.

In preferred form tie fastener 1 (FIG. 1) generally includes a top wall 8, a left side wall 18, a right side wall 28, a bottom wall 38, and a front wall 66. As used herein "left" and "right" refer to the orientation of tie fastener 1 shown in FIG. 1. Top wall 8, left side wall 18, right side wall 28, and bottom wall 38 are all adjoined to one another at their distal ends and are all adjoined to front wall 66 along a longitudinal curved edge of each wall 8 and 38, and side walls 18 and 28. Top wall 8 and bottom wall 38 are substantially parallel to one another and extend between left and right side walls 18 and 28, respectively. Left side wall 18 and right side wall 28 are generally planar diverge outward from one another as they extend upwards from bottom wall 38 to top wall 8. Each respective side wall 18 and 28 extends upward and diverges outward relative to the interior of fastener 1, at an angle of approximately 6 degrees from a perpendicular line extending between top wall 8 and bottom wall 38. Fastener 1 has a substantially hollow interior accessible from the open rear or through any of the four passages 20, 30, 40 and 50 described herein. Top wall 8 as illustrated in FIG. 1, is substantially flat and extends to smoothly rounded transitions into left side wall 18 and right side wall 28.

Figure 2:
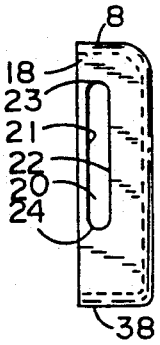
FIG. 2 is a left side elevational view of the tie fastener shown in FIG. 1.

As shown in FIG. 2, left side wall 18 defines left passage or aperture formed by two substantially parallel side edges 21 and 22 which are joined at the top and bottom by a pair of end edges 23 and 24. Each end edge 23 and 24 is semi-circular in shape. Left passage 20 is oriented such that its longitudinal axis is parallel to the longitudinal axis of left side wall 18. Passage 20 may be located anywhere along the length of left side wall 18, however passage 20 is preferably formed near the upper end of left side wall 18 proximate top wall 8, as opposed to the lower end of left side wall 18 proximate bottom wall 38. This preferred positioning of passage 20 avoids fastener 1 from protruding above necktie 70 to an extent where fastener would strike the wearer's chin.

Figure 3:
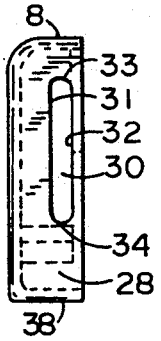
FIG. 3 is a right side elevational view of the tie fastener of FIG. 1.

As shown in FIG. 3, right side wall 28 defines right passage or aperture 30 similar to left passage 20, and which is formed by two substantially parallel side edges 31 and 32 which are joined at the top and bottom by a pair of end edges 33 and 34. Each end edge 33 and 34 is semi-circular in shape. Right passage 30 is oriented such that its longitudinal axis is parallel to the longitudinal axis of right side wall 28. Right passage 30 may be located anywhere along the length of right side wall 28, however passage 30 is preferably formed near the upper end of right side 28 proximate top wall 8, as opposed to the lower end of right side 28 which joins bottom wall 38. Preferably right passage 30 is positioned at a height directly laterally opposite left side passage 20.

Each left passage 20 and right passage 30 is located approximately midway of the depth of left and right side walls 18 and 28, respectively. Left passage 20 extends from an end of left side wall 18 proximate to tie fastener top wall 8 to a region of left side wall 18 proximate to tie fastener bottom wall 38. Similarly, right passage 30 extends from an end of right side wall 28 proximate to top wall 8 to a region of right side wall 28 proximate to bottom wall 38. The distance that left passage 20 extends between the tie fastener top and bottom walls is greater than the depth of left side wall 18. Similarly, the distance that right passage 30 extends between the tie fastener top and bottom walls is greater than the depth of right side wall 28. Moreover, the depth of each of top wall 8, bottom wall 38, left side wall 18 and right side wall 28 is substantially less than either the height or the width of the tie fastener front wall 66.

Figure 4:
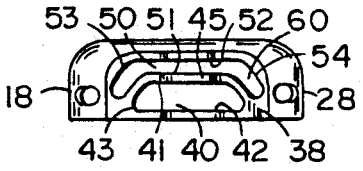
FIG. 4 is a bottom plan view of the tie fastener of FIG. 1.

Bottom wall 38 of tie fastener 1, as illustrated in FIG. 4, provides bottom rear aperture or minor passage 40 and bottom forward aperture or major passage 50 separated by a partitioning bar 45. Bottom major passage 50 is formed in bottom wall 38 such that major passage 50 is nearer than minor passage 40 to an interior surface 64 of front wall 66. Bottom minor passage 40 is formed by two substantially parallel minor side edges 41 and 42 which are joined at opposing ends by a pair of minor end edges 43 and 44. Bottom major passage 50 is formed by two substantially parallel major side edges 51 and 52 joined at opposing ends by a pair of major end edges 53 and 54. Bottom minor passage 40 and major passage 50 are formed such that their longitudinal axes are parallel to one another and preferably also parallel to the longitudinal axis of bottom wall 38. Minor end edges 43 and 44 are generally arcuate to provide minor passage 40 with a generally rounded trapezoidal or rectangular shape, however other geometries may be employed. Major end edges 53 and 54 are primarily U-shaped and formed such that end edges 53 and 54 extend at an acute angle from the longitudinal axis of bottom major passage 50 so as to provide major passage 50 with a widened "U" shape that extends generally along the sides of minor passage 40.

The configuration of major end edges 53, 54 and major side edges 51, 52 is preferably such that end edges 53 and 54 extend toward the open rear of tie fastener 1, as opposed to lying substantially parallel with side edges 51, 52. Such an arrangement results in creating the appearance of a fuller, thicker necktie. Such arrangement also facilitates coverage of the necktie tail, or thinner end of the necktie, by the wide end of the necktie, since the lateral sides of the wide end of the necktie passing through major passage 50 and hanging below the fastener 1 (when worn), are urged towards the wearer's chest, thus shielding the necktie tail located behind.

Minor passage 40, major passage 50, left passage 20 and right passage 30, are all configured or shaped, and are of sufficient dimensions so that they are particularly suited for accommodating an end of a necktie, without the necktie being unnecessarily folded or wrinkled to fit within the respective tie-receiving passage or aperture. Passages 20, 30, 40 and 50 are not so large that when an end of a necktie is inserted through one of these passages, excessive room exists between the tie end and passage. Preferably, the passages are all configured such that the tie end fits snugly within the particular passage.

Figure 5:
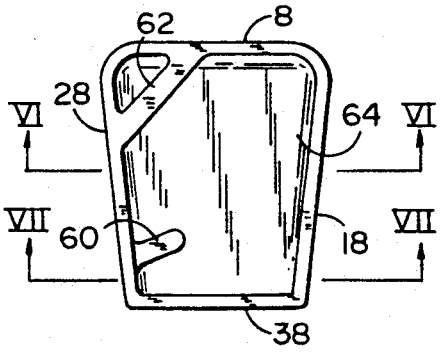
FIG. 5 is a rear elevational view of the tie fastener of FIG. 1.
Figure 6:
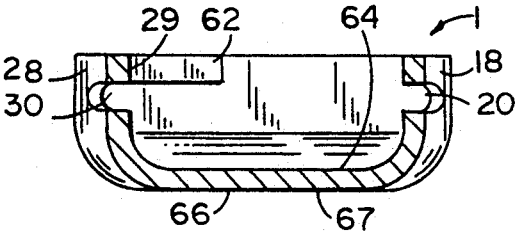
FIG. 6 is a cross-sectional view taken along plane VI—VI shown in FIG. 5.

FIG. 5 illustrates the open rear of the tie fastener. Although the entire rear of fastener 1 need not be open, it is preferred that a substantially open, rear access aperture is provided to enable access for one's fingers when tying a necktie with the present invention. Extending partially across the rear of the fastener, from top wall 8 to right side 28 is a retainer bar 62. Retainer bar 62 extends at a fourty-five degree angle relative to top wall 8. Preferably, the rearward surface of retainer bar 62 is flush with the rearward edge of top wall 8 and rearward most edge of right side wall 28. It is most preferred that retainer bar 62 provide a gap between the frontward surface of retainer bar 62 and the interior surface 64 of front wall 66. Retainer bar 62 extends from one of right side wall 28 or left side wall 18 to top wall 8. Retainer bar 62 is formed between top wall 8 and right 15 side wall 28 such that a flap of necktie material may be inserted underneath it, thereby holding the material in place between bar 62 and interior surface 64 of front wall 66. FIG. 6 illustrates a cross-section of the tie fastener taken along plane VI—VI of FIG. 5, which shows the clearance between retainer bar 62 and the interior surface 64 of front wall 66.

Figure 7:
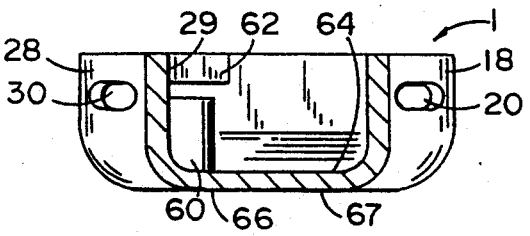
FIG. 7 is a cross-sectional view taken along plane VII—VII shown in FIG. 5.

FIGS. 5 and 7 show an alternative guide wall 60 projecting from the interior surface 64 of front wall 66 and an interior surface 29 of right side wall 28. Guide wall 60 extends inward from right side wall 28 a distance sufficient to engage the necktie material laying next to it when the present invention is used in conjunction with necktie 70. Most preferably such distance is approximately 1/4 to 1/3 of the length of bottom wall 38 or from about ¼ to about ⅓ of the width of the fastener front wall as measured along the bottom wall. (FIG. 5). Guide wall 60 30 extends a distance less than the width of right side wall 28 from interior surface 64 towards the rear of fastener 1. Preferably, guide wall 60 projects toward left side wall 18 from interior surface 29 of fastener right side 28, at an acute angle measured from the interior surface 29 of right side 28 extending between retainer bar 62 and guide wall 60. Such angle assists in further engaging the necktie, thereby securing it to the fastener body.

Guide wall 60 and retainer bar 62 are not limited to their respective locations on right side wall 28 of fastener 1. Rather, fastener embodiments are envisaged wherein either guide wall 60 or retainer bar 62, or both, are formed at the appropriate locations on left side wall 18 of fastener 1.

Figure 8:
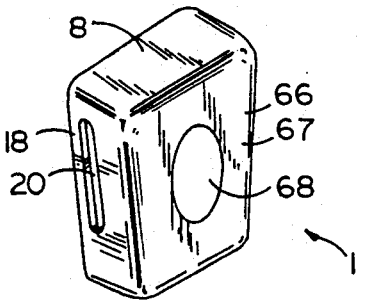
FIG. 8 is a perspective view of the tie fastener shown in FIG. 1.

FIG. 8 illustrates the external geometry of the tie fastener of the present invention. Preferably, fastener 1 has rounded edges between all adjoining surfaces. An optional ornament 68 may be affixed to a front wall outer surface 67 of fastener 1.

Figure 9:
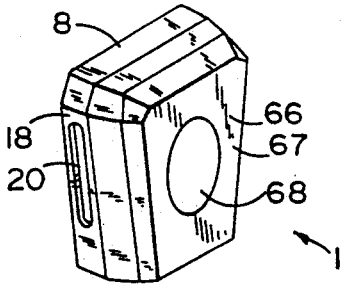
FIG. 9 is a perspective view of an alternate embodiment of a tie fastener embodying the invention.

The exposed outer surfaces of fastener 1 may be polished, painted, engraved or otherwise altered as the wearer desires. An alternative fastener 100 may be formed having beveled or angled edges as illustrated in FIG. 9, joining a top wall 108, a left and a right side wall 118 and 128 respectively, and a front wall 166.

The tie fastener of the present invention may be formed from a variety of materials. The preferred material is bronze, however other suitable materials including other similar soft malleable metals may be utilized such as brass.

The body of tie fastener 1, is preferably formed by casting. After casting, passages 20, 30, 40 and 50 are formed by appropriate machining techniques.

Figure 10:
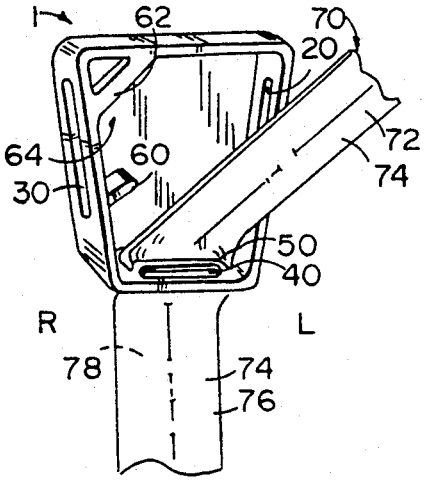
FIGS. 10–14 are sequential, perspective views of the tie fastener of FIG. 1, illustrating the method of securing a necktie by use of the tie fastener.
Figure 11:
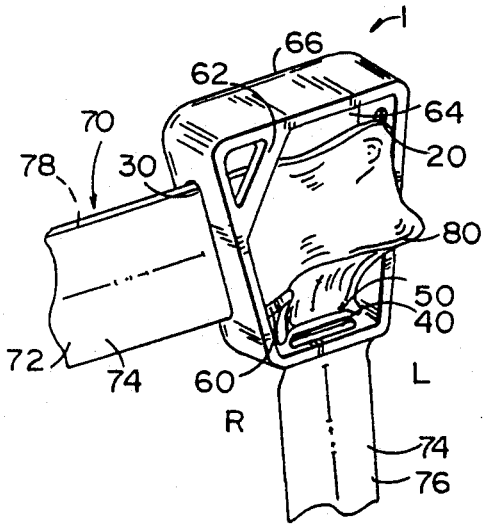
Figure 12:
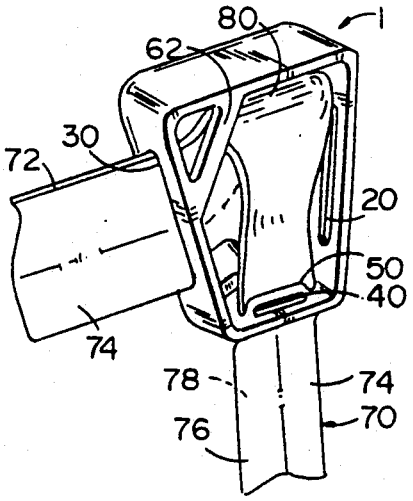

Tie fastener 1 is used in conjunction with necktie 70 as illustrated in FIGS. 10–14. As shown, necktie 70 has a narrow end or tail 72, a rear face 74 which includes the seam, a wide end or head 76, and a decorative front face 78. Referring to FIG. 10, tail 72 is passed through bottom major passage 50, towards the interior of tie fastener 1 such that rear face 74 of tail 72 faces the same direction as the rear of the tie fastener 1. Thus, the tie's decorative front face 78 faces front wall interior surface 64 of fastener 1. As a next step, tail 72 is pulled through major passage 50 so that wide end 76 of necktie 70 hangs below fastener 1 at the desired length. Necktie tail 72 is then passed from the interior of tie fastener 1 outwards, through right side passage 30 as shown in FIG. 11. At this juncture, tie front face 78 of tail 72 should face the same direction as outer surface 67 (not shown in FIG. 11) of fastener front wall 66. The change in direction of the necktie within the fastener interior is accommodated by grasping the resulting triangular-shaped fold of material 80, and tucking it beneath retainer bar 62 as illustrated in FIG. 12.

Figure 13:
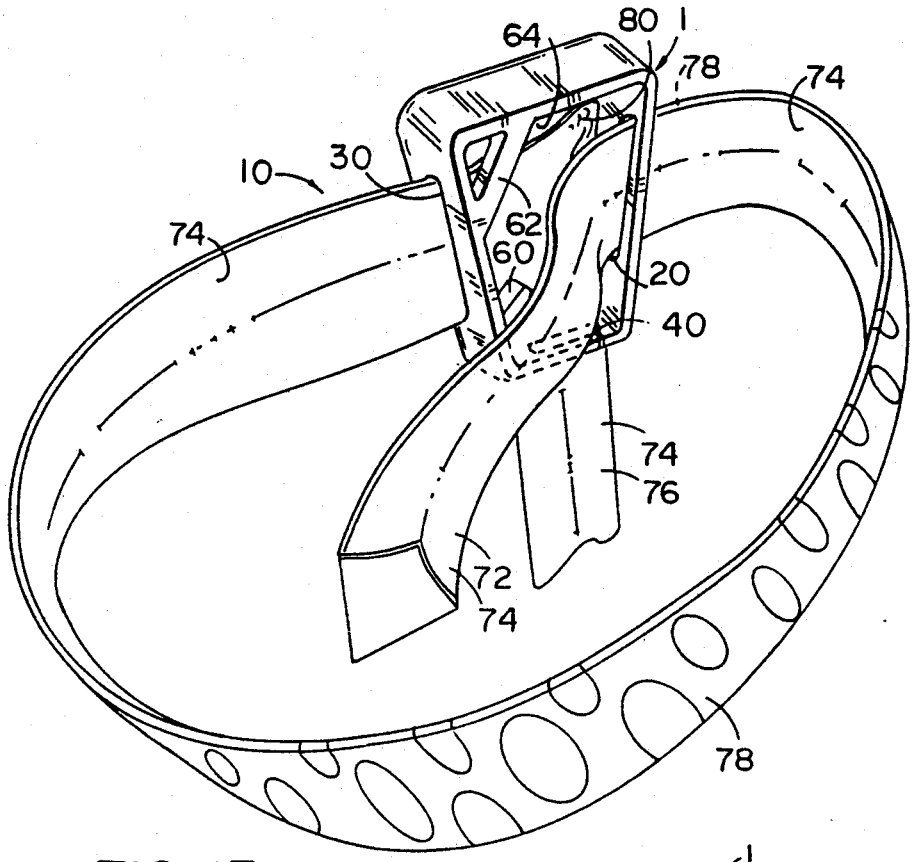

Tail 72 is then brought in a wide loop across the rear of fastener 1 to left side wall 18, and passed from the exterior through left passage 20 towards the fastener interior as shown in FIG. 13. The wide loop so formed must accommodate the head of the wearer. Tie front face 78 of tail 72 should now face interior surface 64 of front wall 66. Tail 72 is pulled inwards through left passage 20 a sufficient distance such that ample room remains for the wearer to pass his or her head through the resulting loop formed by necktie 70.

Figure 14:
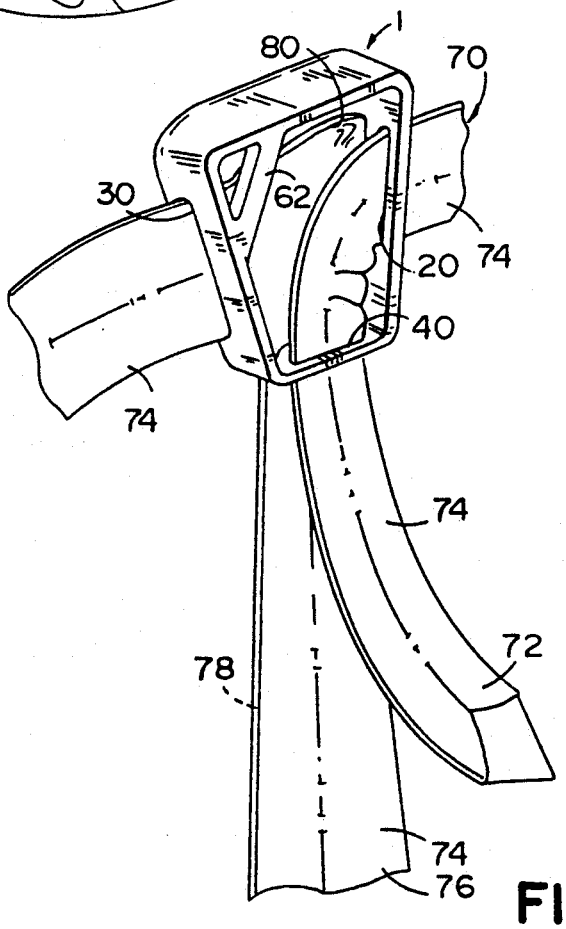

Tail 72 is then fed from the interior of the tie fastener outwards, through bottom minor passage 40 as shown in FIG. 14. Care should be taken such that rear face 74 of tail 72 faces the same direction as the rear of tie fastener 1 and the rear face 74 of wide end 76 of the necktie. At this stage, the wearer then places the necktie 70 and fastener 1 combination over his or her head. The wearer then tightens the necktie loop by gently sliding fastener 1 up towards his or her neck while holding necktie tail 72.

Of course, it is understood that the foregoing is merely a preferred embodiment of the invention and that various changes and alterations can be made without departing from the spirit and broader aspects thereof as set forth in the appended claims.

The embodiments of the invention in which an exclusive property or privilege is claimed are defined as follows:

1. A tie fastener for retaining and securing a necktie about a wearer's neck, said fastener comprising a front wall having a height, a width, an outer surface and an interior surface; said fastener further comprising a top wall, a bottom wall, a left side wall and a right side wall all extending rearwardly from said interior surface of said front wall; said top wall, said bottom wall, said left side wall and said right side wall each having a depth and all being integral with said front wall and with one another; said depth of said top wall, said bottom wall, said left side wall and said right side wall all being substantially less than said height and less than said width of said front wall; said front wall, said top wall, said left side wall, said bottom wall, and said right side wall defining a tie-receiving interior extending rearwardly of said front wall, said interior being sufficiently accessible from said rear of said fastener to permit a user to reach within said interior and adjust a portion of said necktie disposed within said interior;

said left side wall defining a left passage therethrough, said left passage located approximately midway of said depth of said left side wall, said left passage configured to pass an end of said necktie therethrough, said left passage extending from a region of said left side wall proximate to said top wall to a region of said left side wall proximate to said bottom wall a distance greater than said depth of said left side wall;

said right side wall defining a right passage therethrough, said right passage located approximately midway of said depth of said right side wall, said right passage configured to pass said end of said necktie therethrough, said right passage extending from a region of said right side wall proximate to said top wall to a region of said right side wall proximate to said bottom wall a distance greater than said depth of said right side wall;

said bottom wall defining a minor passage therethrough and a major passage therethrough, both said minor passage and said major passage configured to pass said end of said necktie therethrough, said major passage located in a region of said bottom wall proximate to said front wall and said minor passage located in a region of said bottom wall proximate to said rear of said fastener.

2. A tie fastener in accordance with claim 1, further comprising:

a retainer bar extending partially across said tie-receiving interior and opposite said interior surface of said front wall wherein said retainer bar extends in a plane substantially parallel to said front wall of said tie fastener, and provides an amount of clearance between said retainer bar and said interior surface of said front wall.

3. A tie fastener in accordance with claim 1, further comprising:

a guide wall, said guide wall adjoined to said right side wall and extending inwards toward said left side wall of said fastener, said guide wall adjoined to said interior surface of said front wall.

4. A tie fastener in accordance with claim 3, wherein said guide wall extends inwards a distance from about $\frac{1}{4}$ to about $\frac{1}{3}$ of said width of said fastener front wall, said width measured along said bottom wall, said guide wall adjoined to said interior surface of said front wall along the entire distance of inward extension of said guide wall.

5. A tie fastener in accordance with claim 1, further comprising:

a decorative ornament affixed to said outer surface of said fastener front wall.

6. A tie fastener in accordance with claim 1, wherein said left side wall and said right side wall downwardly converge from said top wall to said bottom wall.

7. A tie fastener in accordance with claim 1, wherein said left passage is primarily located in a region of said left side wall proximate to said top wall, and said right passage is primarily located in a region of said right side wall proximate to said top wall.

8. A tie fastener for retaining and securing a necktie, having first and second ends, about a wearer's neck, said fastener comprising:

a front wall having a height, a width, a top region and a bottom region;

at least a pair of laterally spaced side walls each having a depth, said side walls joined to said front wall and extending rearwardly therefrom, said side walls each defining a tie-receiving side aperture therethrough, said side apertures configured for pulling one end of said necktie therethrough;

a bottom wall coupled to said bottom region of said front wall, said bottom wall having a depth, said bottom wall defining a tie-receiving rear aperture therethrough and a tie-receiving forward aperture therethrough, said tie-receiving forward aperture being disposed between said front wall and said rear aperture, said rear aperture and said forward aperture configured for pulling said one end of said necktie therethrough;

wherein said depth of said side walls and said bottom wall is substantially less than said height and less than said width of said front wall, wherein each said side aperture is disposed approximately midway of said depth of said side walls, wherein each said side aperture extends generally along said height of said fastener front wall a distance greater than said depth of said side walls, said front wall, said side walls and said bottom wall cooperating to define a tie-receiving interior extending rearwardly of said front wall, said side walls and said bottom wall further defining a rear access opening communicating with said interior, said rear access opening being sufficiently large to permit a user to reach within said interior and adjust a necktie disposed within said interior.

9. A tie fastener in accordance with claim 8, wherein said side walls are generally planar and upwardly diverge from one another, from said bottom wall to said top region of said front wall.

10. A tie fastener in accordance with claim 8, wherein said side apertures are located in regions of said side walls generally proximate to said front wall top region.

11. A tie fastener in accordance with claim 8, further comprising a top wall coupled to said front wall.

12. A tie fastener in accordance with claim 8, further comprising a retainer bar extending from at least one of said side walls, said retainer bar proximate to said front wall and spaced therefrom sufficiently to permit a necktie to be disposed therebetween.

13. A tie fastener in accordance with claim 12, wherein said retainer bar extending from at least one of said side walls is further proximate to said front wall top region.

14. A tie fastener in accordance with claim 12, wherein said retainer bar extends across at least a portion of said rear access opening formed by said side walls and said bottom wall, said retainer bar extending across said rear access opening at an angle of approximately 45 degrees to one of said side walls.

15. A method of securing a necktie about a wearer's neck and restraining it from loosening or slipping, comprising:

providing a necktie having a narrow tail end and a wide head end formed at opposite ends of its length, said necktie further having a decorative front face, and seam containing rear face;

providing a tie fastener having a front all having an interior surface, a top wall, a left side having a left passage formed therethrough, a right side having a right passage formed therethrough, and a bottom wall having a minor passage and a major passage formed therethrough, wherein said top wall, said left side, said bottom wall, and said right side define a tie-receiving interior rearwardly of said front wall, said side walls and said bottom wall further defining a rear access opening, communicating with said interior, said rear access opening being sufficiently large to permit a user to reach within said interior and adjust a necktie disposed within said interior;

inserting said tail end of said necktie through said bottom major passage from a region exterior to said fastener to said interior of said fastener, such that said front face of said necktie faces said interior surface of said front wall of said fastener;

pulling said tail end through said bottom major passage a distance less than said length of said necktie wherein said rear face of said head end of said necktie faces in the direction of said rear access opening;

inserting said tail end of said necktie through said right passage from said interior of said fastener to said exterior region such that said front face of said tail end faces said interior surface of said front wall of said fastener;

pulling said tail end through said right passage such that a fold of said necktie results from a change in direction of said necktie within said interior of said fastener;

passing said tail end of said necktie across the rear of said fastener;

inserting said tail end of said necktie through said left passage from said exterior region to said interior of said fastener such that said front face of said tail end of said necktie faces said interior surface of said front wall of said fastener, whereby a loop is formed in said necktie;

inserting said tail end of said necktie through said bottom minor passage from said interior of said fastener to said exterior region such that said rear face of said tail end of said necktie faces the same direction as said rear face of said head end of said necktie; and pulling said tail end of said necktie through said bottom minor passage whereby said loop is adjusted to a desired size.

16. A method of securing a necktie in accordance with claim 15 wherein said tie fastener has a retainer bar extending at least partially across said rear opening between said top wall and said right side, said retainer bar being sufficiently spaced from said interior surface of said front wall to allow insertion of said necktie between said retainer bar and said interior surface of said front wall, said method further comprising:

tucking said fold of said necktie between said retainer bar and said interior surface of said front wall of said fastener.

* * * * *

UNITED STATES PATENT AND TRADEMARK OFFICE

CERTIFICATE OF CORRECTION

PATENT NO. : 5,218,722

DATED : Jun. 15, 1993

INVENTOR(S) : Mark L. Vandenberg

It is certified that error appears in the above-indentified patent and that said Letters Patent is hereby corrected as shown below:

Column 2, line 35
After "aperture" insert --20--;

Column 2, line 47
After "fastener" insert --1--;

Column 4, line 8
Before "side" delete --15--;

Column 4, line 26
Before "extends" delete --30--;

Column 7, line 51, claim 15
"front all" should be --front wall--;

Signed and Sealed this

Tenth Day of May, 1994

Bruce Lehman

*Attest:*

BRUCE LEHMAN

*Attesting Officer*

*Commissioner of Patents and Trademarks*